United States Patent [19]

Asanuma et al.

[11] Patent Number: 5,009,187

[45] Date of Patent: Apr. 23, 1991

[54] DEVELOPING DEVICE WITH SHUTTER

[75] Inventors: Masato Asanuma; Masatoshi Kaneshige, both of Nara, Japan

[73] Assignee: Sharp Kabushiki Kaisha, Osaka, Japan

[21] Appl. No.: 228,527

[22] Filed: Aug. 4, 1988

[30] Foreign Application Priority Data

Aug. 25, 1987 [JP] Japan ..... 62-129478[U]
Aug. 25, 1987 [JP] Japan ..... 62-129479[U]

[51] Int. Cl.[5] ..... G03G 15/09

[52] U.S. Cl. ..... 118/658; 355/251; 355/253

[58] Field of Search ..... 355/3 DD, 14 D; 118/658, 657, 689, 656

[56] References Cited

U.S. PATENT DOCUMENTS 4,607,933 8/1986 Haneda et al. ..... 355/3 DD
4,699,079 10/1987 Palm et al. ..... 355/253 X
4,716,437 12/1987 MacLellan ..... 355/3 DD
4,739,365 4/1988 Hino ..... 355/246
4,748,471 5/1988 Adkins ..... 355/3 DD
4,758,861 7/1988 Nakamaru et al. ..... 355/3 DD X

*Primary Examiner*—A. T. Grimley
*Assistant Examiner*—Robert Beatty
*Attorney, Agent, or Firm*—Flehr, Hohbach, Test, Albritton & Herbert

[57] ABSTRACT

A developing device for an electrophotographic copier includes a shutter along its toner supply route and a toner concentration detector sensor connected to a timing circuit. If the toner concentration is detected low, the timing circuit causes the toner supply to continue even after development is completed and the shutter is closed. An auxiliary stirrer is provided to keep stirring freshly supplied toner even after development is completed and the shutter is closed.

10 Claims, 4 Drawing Sheets

FIG._5.
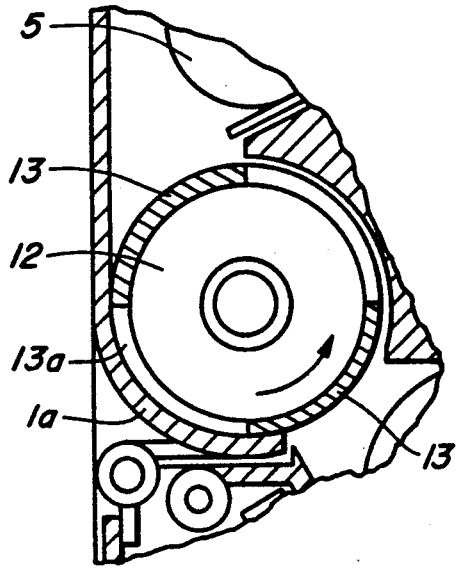
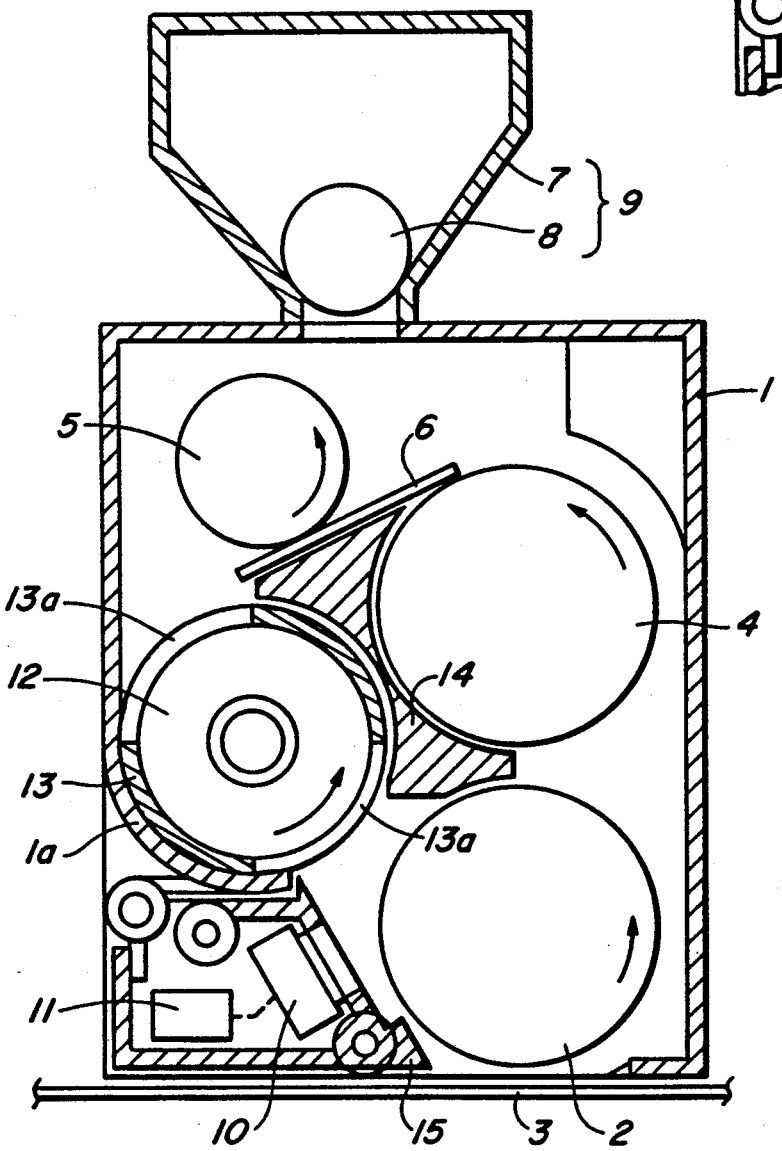
FIG._4.

DEVELOPING DEVICE WITH SHUTTER

BACKGROUND OF THE INVENTION

This invention relates to a developing device for an electrophotographic copier or a laser printer for developing an electrostatic latent image formed on a recording medium.

An electrophotographic copier or the like produces a visible image from an electrostatic latent image formed on a recording medium by attaching toner made of color pigments to this electrostatic latent image. In order to produce an image in different colors instead of a simply black and white image, there are image formation apparatus such as copiers provided with a plurality of developing devices each containing therein toner of a different color such that these developing devices can be used selectively. A copier adapted to produce a full-color image may be provided, for example, with individual developing devices containing cyanic, magenta and yellow toner and, if necessary, with a developing device with black toner. The individual developing devices develop electrostatic latent image, separately formed on recording media through filters of different colors, by applying toner of these colors. It is very important, therefore, to design these developing devices such that toner therefrom is prevented from getting attached to the electrostatic image when they are not being used for development.

According to a method which has been used commonly for this purpose, the gap between the recording medium and the developing device is controllably changed such that, when the developing device is not used, toner therefrom will not be supplied to the developing region. With an image formation apparatus having a developing device thus structured, however, fluctuations tend to appear in conditions of development, causing changes in image densities and the like. If the gaps cannot be determined accurately, normal images cannot be obtained consistently.

For the case of a developing device using a magnetic brush, there have been attempts to displace the magnet in the developing device such that the magnetic brush is prevented from contacting the recording medium. Displacements of the magnet, however, tend to affect the image density. In the case of a developing device using a two-component developing agent, furthermore, the carrier can still be attached to the recording medium to significantly reduce the image quality.

In view of the above, a new idea has been developed according to which a stirrer roller is provided in the supply route of developing agent to the magnetic roller opposite to the recording medium and a cylindrical shutter having slits is engaged coaxially around its outer periphery. Not only is this shutter rotated controllably to open and close the supply route, used developing agent is picked up by the magnet roller for the development and is further transported by another magnet roller to a place where stirring is taking place. With a developing device thus structured, the toner therein can be prevented from attaching to an electrostatic image on the recording medium without varying the gap between the developing device and the medium. In addition, a sensor for detecting toner concentration may be provided in the toner supply route between the shutter and the magnet roller for development such that the toner concentration of the developing agent as it is delivered to the magnet roller can be maintained at a uniform level.

If the shutter is closed and the toner supply route is blocked, however, the magnet roller does not form a magnetic brush any more and the sensor cannot detect the toner concentration. As a result, since the magnetic brush remains formed only for a brief period of time, there is not enough time to supply toner sufficiently even if the sensor detects a low toner concentration. In the case of a full-color development, in particular, the developing time for each color, or the time during which a magnetic brush is formed, is extremely short, being only about two seconds. Thus, even if the sensor determines that the toner concentration is low, it is extremely difficult to supply a required amount of toner within such a short period of time. If toner is not sufficiently supplied, not only does the image density become low but also the carrier comes to be attached to the recording medium to adversely affect the image quality.

SUMMARY OF THE INVENTION

It is therefore an object of the present invention to provide a developing device for an electrophotographic image formation apparatus such as a copier with which the aforementioned problems of prior art developing devices can be eliminated.

In view of the above and other objects, a developing device according to the present invention includes a controllable shutter along the toner supply route and a sensor for detecting the toner concentration connected to a timing circuit such that if the toner concentration detected by the sensor is low, the timing circuit causes the toner supply to continue even after the shutter is closed. An auxiliary stirrer is also provided within the toner supply route such that the toner supplied into the developing device after the shutter is closed is stirred and ready to be used.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 4 is a frontal sectional view of another developing device embodying the invention.

FIG. 5 is a portion of FIG. 1 showing the shutter when it is closed.

DETAILED DESCRIPTION OF THE INVENTION

Figure 1:
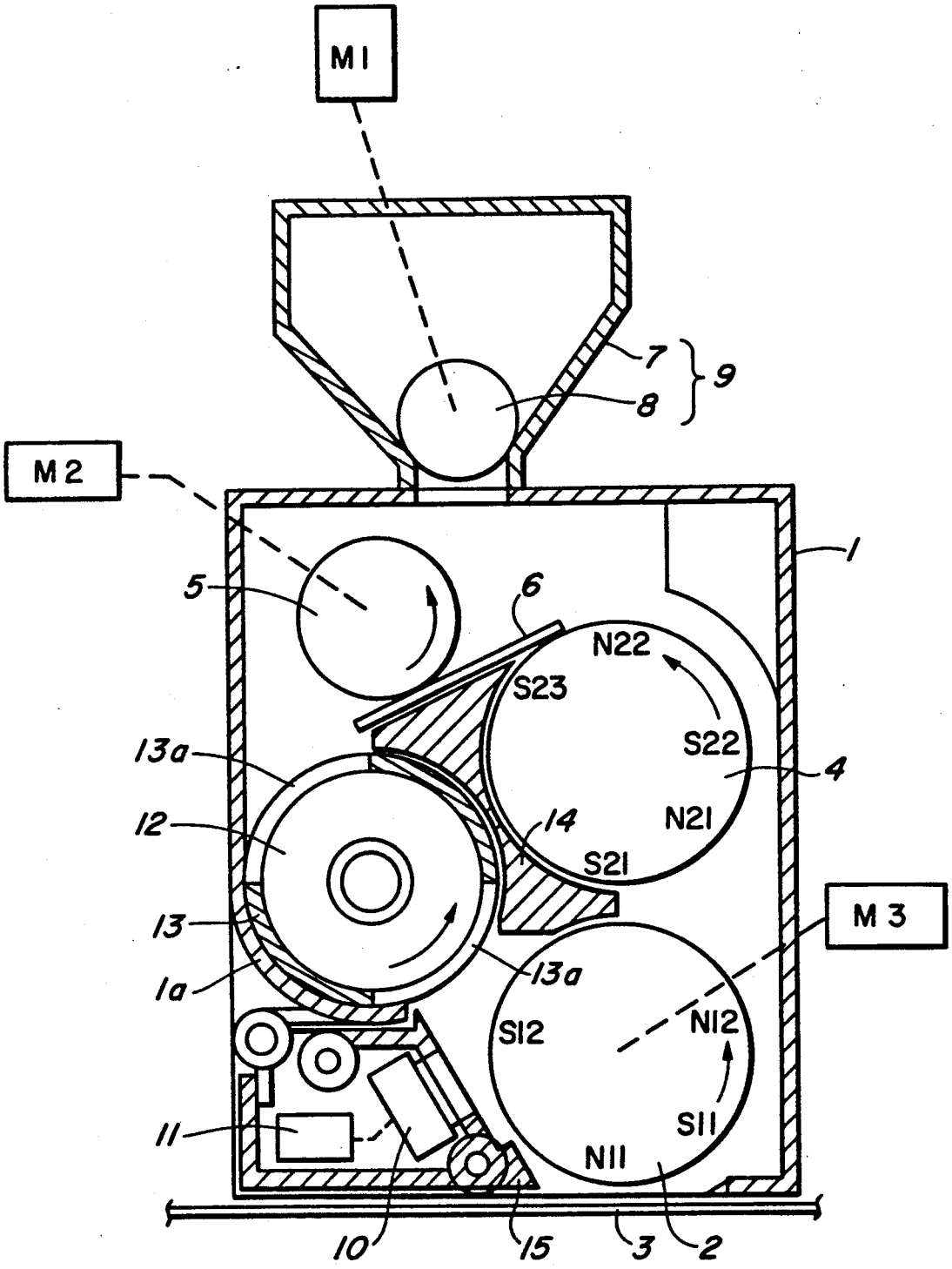
FIG. 1 is a frontal sectional view of a developing device embodying the invention.

A developing device embodying the present invention is described with reference to FIG. 1 wherein numeral 1 indicates its developing tank and numeral 3 indicates a photoreceptor serving as image recording medium. A magnet roller for development 2, which forms a magnetic brush with developing agent by its magnetic force, is rotatably supported inside the developing tank 1. It is comprised of a rotatable cylindrical sleeve made of a non-magnetic material such as aluminum which can be rotated by a motor symbolically shown as M3. Inside this non-magnetic sleeve is a magnet having different poles on its circumference such as $N_{11}$, $S_{11}$, $N_{12}$ and $S_{12}$. This magnet is so set with respect to the developing tank 1 that its S pole is opposite the photoreceptor 3. As the non-magnetic sleeve is rotated by the motor M3 around the magnet thus set, developing agent is magnetically adsorbed onto the surface of the sleeve and forms a brush along the magnetic field line opposite the photoreceptor 3. As this brush is brushed against the electrostatic latent image on the photoreceptor 3, the developing agent forming the magnetic brush is transferred onto the photoreceptor 3, developing the image thereon.

Above the magnet roller for development 2, there is affixed a transportation magnet roller 4 for transporting the developing agent which has been picked up after a development process up to a position where developing agent is stirred. This transportation magnet roller 4 is structured similarly to the aforementioned magnet roller for development 2, having a rotatable non-magnetic sleeve around a magnet fixed with respect to the developing tank 1 and having different poles such as $S_{21}$, $N_{21}$, $S_{22}$, $N_{22}$ and $S_{23}$. Nearly at the top of this transportation magnet roller 4 and near its surface is one end of a scraper 6 for scraping off the developing agent from the surface of the non-magnetic sleeve. This scraper 6 is sloped downward from the aforementioned end part thereof proximal to the transportation magnet roller 4. The other end of the scraper 6 reaches a region where developing agent is stirred.

At the top of the developing tank 1 is a toner hopper 7 which is internally connected to the developing tank 1. A toner supply roller 8 is provided within this hopper 7 and serves to supply a specified amount of toner from the hopper 7 into the developing tank 1. The supply roller 8 is rotated by a motor M1 provided for this purpose. As will be explained more in detail below, a timer circuit 11 is activated by a detection signal from a sensor 10 for detecting toner concentration, activating the motor M1 for a specified period of time. The toner hopper 7, the toner supply roller 8 and its motor symbolically shown as M1 are collectively referred to as the toner supply means 9.

Above and near the scraper 6 is a rotatably supported auxiliary stirrer roller 5 driven by still another motor symbolically shown as M2. This serves not only to auxiliarily stir the toner freshly supplied into the developing tank 1 from the toner supply means 9 but also to stir and mix it with the developing agent scraped by the scraper 6 from the transportation magnet roller 4. The developing agent thus stirred and mixed with the freshly supplied toner is carried into the stirring region of the developing tank 1 by the rotation of this auxiliary stirrer roller 5.

The aforementioned stirring region of the developing tank 1 includes a stirrer roller 12 and a cylindrical tubular shutter 13 with slits 13*a* formed on its wall at diametrically opposite positions and coaxially engaging the outer peripheral surface of the stirrer roller 12. The stirrer roller 12 is disposed downstream from the auxiliary stirrer roller 5 along the supply route along which the developing agent carried from the transportation magnet roller 4 is supplied back to the magnet roller for development 2. Rotations of the shutter 13 and the stirrer roller 12 are independently controlled. While the shutter 13 is connected to its own motor (not shown), the stirrer roller 12 is connected to the driver motor M3 for the magnet roller for development 2 so as to be driven together therewith. When the shutter 13 is at the angular position depicted in FIG. 1, its slits 13*a* open the supply route and the developing agent is supplied to the magnet roller for development 2 but when the slits 13*a* are at rotated positions by 90 degrees as shown in FIG. 5, the supply route is blocked.

While the electrostatic latent image formed on the photoreceptor 3 is being developed, the shutter 13 of only the developing device required for its color is set to open its supply route. When the development process by this developing device is completed, the sensor 10 yet to be fully described below detects the toner concentration while the shutter 13 is still in the open position and the shutter 13 is thereafter rotated by about 90 degrees such that the supply route is blocked by a partition member 14 and a curved wall 1*a* of the developing tank as well as the wall parts of the shutter 13 itself, stopping the introduction of developing agent to the magnet roller for development 2.

Along the toner supply route between the shutter 13 and the magnet roller for development 2 is a doctor blade 15 for controlling the amount of developing agent to be adsorbed to the surface of the magnet roller for development 2. The aforementioned sensor 10 for detecting the toner concentration being supplied to the magnet roller for development 2 is attached to this doctor blade 15. Connected to this sensor 10 is a timer circuit 11 for controlling the timing of the toner supply roller 8 such that, when the sensor 10 detects a certain preset concentration level to thereby switch on the timer circuit 11, the timer circuit 11 not only drives the motor M1 of the toner supply means 9 for a preset period of time but also starts up the motor M2 for the auxiliary stirrer roller 5 and stops it by waiting a predetermined length of time after the motor M1 stops. In short, the toner supply means 9 is programmed to be able to supply a specified amount of toner into the supply route even after the shutter 13 is closed.

With a developing device thus structured, if the non-magnetic sleeve of the magnet roller for development 2 is rotated during a development process as shown by an arrow shown thereon in FIG. 1, the magnetic brush formed thereon by magnetic adsorption is rubbed against the electrostatic latent image on the photoreceptor 3 and a visible image is formed thereon. Thereafter, the used developing agent is picked up by the magnet roller for development 2 and transported up to the position of the transportation magnet roller 4. Since the non-magnetic sleeve of the transportation magnet roller 4 is rotating also as shown by an arrow shown thereon in FIG. 1 and transports the developing agent upward until it is scraped off therefrom by the scraper 6. After scraped off by the scraper 6, the used developing agent is stirred by the auxiliary stirrer roller 5 rotating as shown by an arrow thereon in FIG. 1 and is transported along the scraper 6 to the stirring region.

At the stirring region, if the shutter 13 is in the open position as shown in FIG. 1, the developing agent flows into the stirrer roller 12 through one of the slits 13*a* and is stirred before flowing out thereof through the other of the slits 13*a* back to the magnet roller for development 2 along the toner supply route.

When a developing operation is completed, the shutter 13 is rotated by about 90 degrees to block the toner supply route. This stops the supply of developing agent to the magnet troller for development 2 and no magnetic brush is formed on its sleeve any more. As shown by the flow chart of FIG. 2 for the operation of the developing device and the timing chart of FIG. 3 for its components, however, the sensor 10 detects the toner concentration (S2) after the development process is completed (S1) but before the shutter 13 is operated to block the toner supply route. If the sensor 10 detects High (meaning low toner concentration), the motor (not shown) for operating the shutter 13 is activated for a preset period of time $t_1=0.5$ sec from the time when the command to stop the developing operation is received, thereby closing the shutter 13 (S3). Another preset time period $t_2=1$sec after the shutter 13 is closed, the motor M3 is switched off to stop the magnet roller for development 2 and the stirrer roller 12 (S4). Simultaneously, a timer in the timer circuit 11 is switched on (S5) and the motor 1 of the toner supply means 9 is started up to start the supply of toner (S6). Alternatively, the toner supply roller 8 may be programmed to start rotating not after the magnet roller for development 2 has stopped but in response to the driving of the shutter 13, that is, it may be programmed to start rotating as soon as the sensor 10 outputs a High signal. In such a case, the auxiliary stirrer roller 5 may be programmed for a restart simultaneously with the starting of the toner supply roller 8 or the auxiliary stirrer roller 5 may be rotated continuously.

Thus, the auxiliary stirrer roller 5 either is continuously rotating or restarts to rotate when the timer is switched on (S7). A still another preset time period $t_3=1$sec thereafter, the timer in the timer circuit 11 operates (S8) to switch off the motor M1 (S9) to start the supply of toner from the hopper 7. A still further preset time period $t_4=2$sec thereafter, the timer in the timer circuit 11 operates again to switch off the motor M2 to stop the auxiliary stirrer motor 5 (S1O).

If the output signal from the sensor 10 is not High (NO in S2) when the developing operation is completed (S1), the timer in the timer circuit 11 is in the switched-off condition, and since the toner concentration is still in an allowable range, the shutter 13 is closed (S11) and all driving systems of the device are stopped (S12). Since the auxiliary stirrer roller 5 is not rotated, toner is not supplied.

Figure 2:
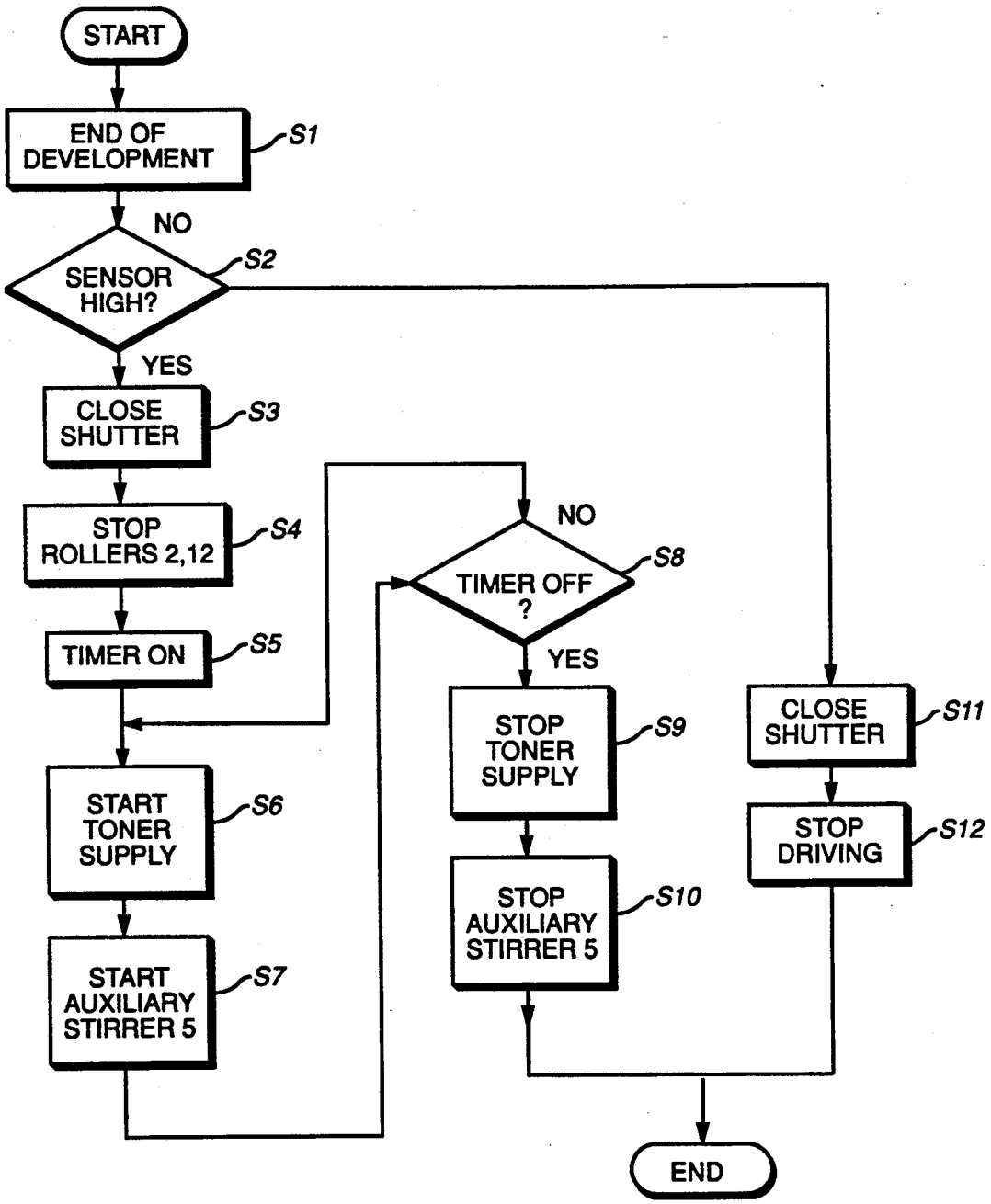
FIG. 2 is a flow chart of the operation of the developing device of FIG. 1.
Figure 3:
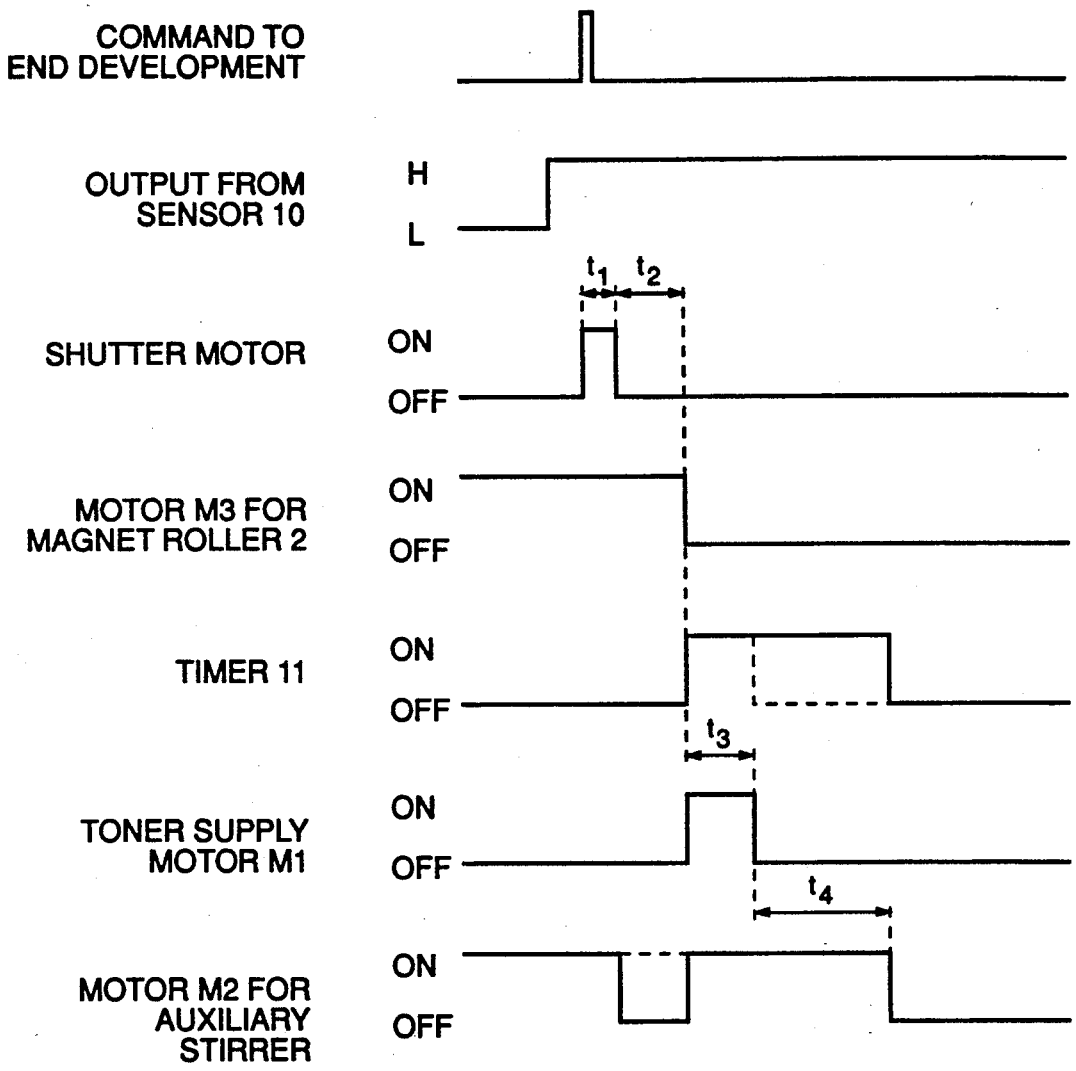
FIG. 3 is a timing chart of the operation of the developing device of FIG. 1.

The foregoing description of a preferred embodiment of the invention has been presented for purposes of illustration and description. It is not intended to be exhaustive or to limit the invention to the precise form disclosed, and many modifications and variations are possible in light of the above teaching. For example, the auxiliary stirrer roller 5 may be removed as shown in FIG. 4 and the amount of toner consumption is anticipated such that the timer serves to control the toner supply even after the aforementioned magnetic brush is stopped. Operation of such a simplified device may be shown by the same flow chart as shown in FIG. 2 except Steps S7 and S10 are removed. Such a simplified device, although within the scope of the present invention, is disadvantageous in that the toner supplied after the other drive systems of the device have been stopped is not stirred at all. Any modifications and variations that may be apparent to a person skilled in the art are intended to be included within the scope of this invention.

What is claimed is:

1. A developing device comprising a developing region where development takes place, a toner receiving region, a toner supplying means for supplying toner into said toner receiving region, a toner supply route along which toner is delivered from said toner receiving region to said developing region, a toner recycling route along which used toner is returned from said developing region to said toner receiving region, a shutter disposed in said toner supply route for selectably opening and closing said toner supply route, a magnetic toner recycling roller disposed entirely in said toner recycling route for delivering used toner through said toner recycling route, a partition member which is disposed between said shutter and said magnetic toner recycling roller and separates said toner supply route from said toner recycling route, a sensor disposed along said toner supply route between said shutter and said developing region for detecting toner concentration, and a timer circuit for effecting timing control on said toner supplying means such that a specified amount of toner is supplied into said toner receiving region after said shutter is closed if said sensor detects a specified toner concentration level.

2. The developing device of claim 1 further comprising an auxiliary stirrer disposed in said toner receiving region and controlled by said timer circuit for stirring freshly supplied toner together with recycled toner returned to said toner receiving region through said toner recycling route, said timer circuit serving to stop said auxiliary stirrer a specified time period after said toner supply means is stopped.

3. The developing device of claim 1 further comprising a stirrer roller having an outer peripheral surface and said shutter comprising a rotatably supported tubular cyclinder having two slits formed diametrically opposite to each other and coaxially engaging with said outer peripheral surface of said stirrer roller.

4. The developing device of claim 2 further comprising a stirrer roller having an outer peripheral surface and said shutter comprising a rotatably supported tubular cylinder having two slits formed diametrically opposite to each other and coaxially engaging with said outer peripheral surface of said stirrer roller, said stirrer roller being disposed downstream from said auxiliary stirrer along said toner supply route.

5. The developing device of claim 1 further comprising a magnet developer roller disposed in said developing region for applying toner to develop an image and transporting toner into said toner recycling route.

6. The developing device of claim 1 further comprising a scraper disposed below said toner supplying means and substantially in contact with said magnetic toner recycling roller for scraping off toner therefrom.

7. The developing device of claim 2 further comprising a scraper disposed below said toner supplying means and substantially in contact with said magnetic toner recycling roller for scraping off toner therefrom.

8. The developing device of claim 6 wherein said scraper has an upper surface which is sloping downward toward said toner supply route.

9. The developing device of claim 7 wherein said scraper has an upper surface which is sloping downward toward said toner supply route and is substantially in contact also with said auxiliary stirrer.

10. The developing device of claim 3 wherein said partition member has two concave cylindrical surfaces which are respectively opposite said tubular cylinder of said shutter and said magnetic toner recycling roller.

* * * * *